US005588743A

United States Patent [19]

Mayo et al.

[11] Patent Number: 5,588,743

[45] Date of Patent: Dec. 31, 1996

[54] LUMINAIRES

[75] Inventors: Kevin Mayo; Mark Wiltshire, both of Nr Banbury, United Kingdom

[73] Assignee: Menvier (Electronic Engineers) Ltd., Banbury, United Kingdom

[21] Appl. No.: 324,761

[22] Filed: Oct. 17, 1994

[30] Foreign Application Priority Data

Nov. 17, 1993 [GB] United Kingdom ..... 9323663

[51] Int. Cl.[6] ..... F21V 7/12

[52] U.S. Cl. ..... 362/299; 362/327; 359/726

[58] Field of Search ..... 362/299, 296, 362/327, 328, 341, 330, 339, 433; 359/565, 627, 726

[56] References Cited

U.S. PATENT DOCUMENTS

| | | | |
|---|---|---|---|
| 3,944,809 | 3/1976 | Moore et al. | 362/433 |
| 4,081,667 | 3/1978 | Lewin et al. | 362/296 |
| 4,185,895 | 1/1980 | Stephens et al. | 362/346 |
| 4,789,921 | 12/1988 | Aho | 362/348 |
| 4,994,947 | 2/1991 | Fesko | 362/297 |
| 5,029,060 | 7/1991 | Aho et al. | 362/299 |
| 5,446,594 | 8/1995 | Nelson et al. | 359/742 |

*Primary Examiner*—Ira S. Lazarus
*Assistant Examiner*—Sara Sachie Raab
*Attorney, Agent, or Firm*—Christie, Parker & Hale, LLP

[57] ABSTRACT

A luminaire, for example a luminaire for emergency lighting, comprises a light source and an optical element mounted behind the light source, the element being shaped as a fresnel type element so that substantially all the light impinging upon it from the light source is redirected at a specific angle, typically 60°. The element increases the light output over a specific area.

8 Claims, 3 Drawing Sheets

LUMINAIRES

BACKGROUND OF THE INVENTION

This invention relates to luminaires. In particular, but not exclusively, it relates to emergency luminaires which are generally battery operated and are intended to come into operation upon failure of the main supply in a building. The invention is also applicable to luminaires in general.

DESCRIPTION OF THE PRIOR ART

The term luminaire is generally used to define a light fitting generally comprising a light source which is often a fluorescent lamp, a simple reflector or cover behind the lamp and (usually) a diffuser cover to protect the lamp from dirt or mechanical damage. The maximum light output from such a luminaire is directly in front of (or under) the luminaire and decreases with distance from the maximum point. The plain reflector behind the lamp reflects a portion of the back light that would otherwise be wasted. However, this light is allowed to be dispersed in all directions and hence is largely lost.

Luminaires, in particular luminaires for emergency lighting, are installed to ensure that at least a certain light level is achieved over a specified area. This means that in use a large proportion of the area specified will be illuminated to a level greater than is required in order to illuminate the total area with the threshold light level. Thus, the total area is smaller than could be theoretically achieved from a given battery and lamp combination.

It is an object of the present invention to provide an improved luminaire.

BRIEF DESCRIPTION OF THE INVENTION

According to the present invention there is provided a luminaire, comprising a light source, and means disposed behind the light source to cause light impinging upon it from the light source over a range or ranges of angles to be redirected at a chosen angle.

If a luminaire is intended to be ceiling- or wall-mounted then, the redirecting means will generally, in use, be disposed between the light source and the ceiling or wall respectively. It may be in other relative positions, however.

The luminaire may include a rear wall, and a separate redirecting means interposed between the light source and the rear wall. Alternatively the rear wall may itself be shaped to cause the redirecting.

Preferably, the redirecting means comprises a means for using total internal reflection to cause the light to be redirected.

In a preferred embodiment, the redirecting means is a Fresnel type lens shaped so that light impinging upon it from a point or line on its central axis is caused to be redirected at a specific angle. The angle may be 60 ° to the central axis of the luminaire.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS OF THE INVENTION

Figure 1:
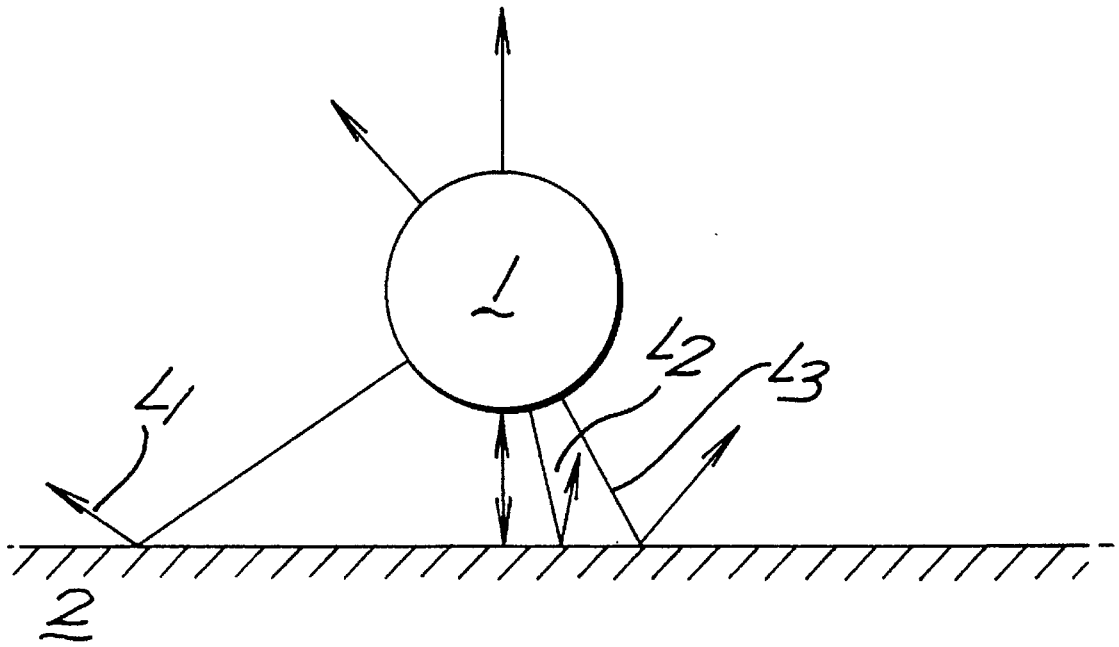
FIG. 1 (PRIOR ART)
FIG. 1 shows a prior proposed lamp assembly.

As shown in FIG. 1, in conventional lamp assemblies some of the light emitted rearwards from a lamp 1 falls upon a rear reflector 2 and is reflected. As shown by the various light rays L1, L2 and L3 the light is reflected on this reflector in different directions and thus generally dispersed. A proportion of the light is not reflected at all but is absorbed in the reflector 2. Thus, a larger amount of light emitted from the lamp 1 is wasted by being absorbed or by being reflected in an unwanted direction.

A diffuser would also generally be present above and to the sides of the lamp 1, but this has been omitted from the drawings for clarity.

Figure 2:
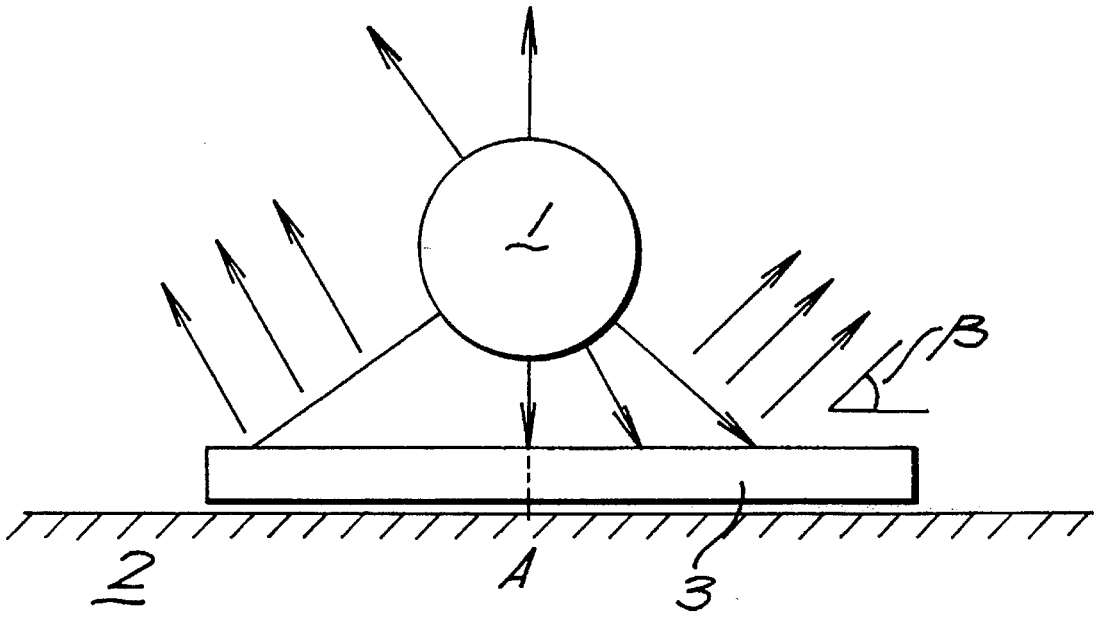
FIG. 2 shows schematically a lamp assembly of the present invention.

FIG. 2 shows a system according to the present invention in which a further element 3 is inserted between the lamp 1 and reflector 2. This element has the property that light incident upon it in a direction from a point along the central axis line A is emitted at a fixed angle β. As shown, light incident upon element 3 over a range or ranges of angles is redirected at the fixed angle β. Thus, more of the light is directed in a desired direction and the total area satisfactorily illuminated from a luminaire according to the present invention is greater than could be achieved previously for a given lamp/battery combination.

Figure 3:
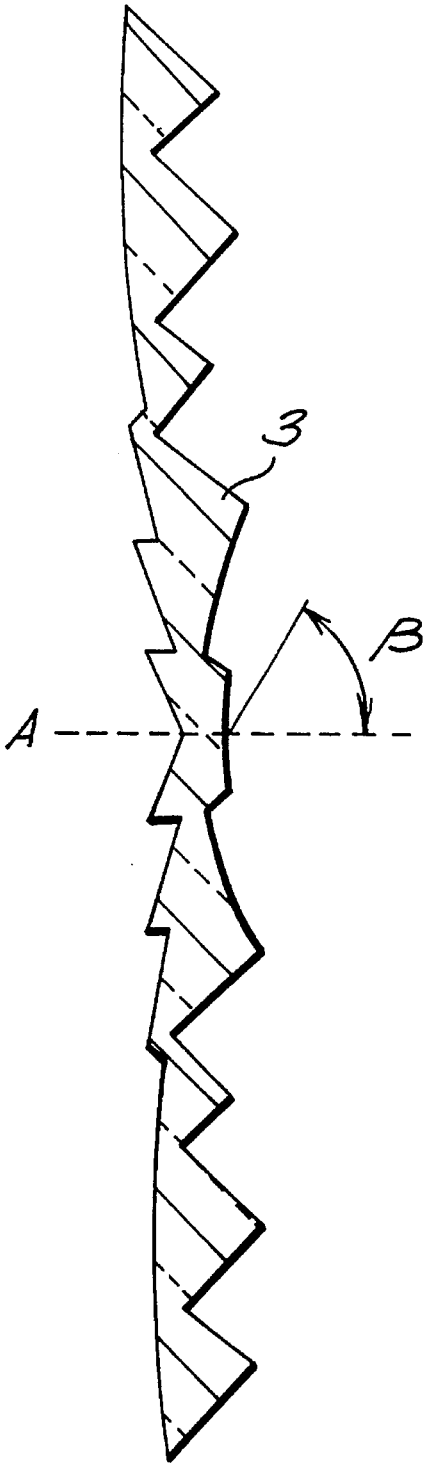
FIG. 3 shows the cross section of a reflecting/refracting element.

Many different types of elements 3 may have the property of reflecting the light in a specific chosen direction. One of these is shown in FIG. 3. The element shown in FIG. 3 is a Fresnel type lens element which has the property of reflecting light from any point on its central axis A at a specific angle β which is around 60° for the configuration shown. The element is typically of glass or plastics material of known optical properties. Other shapes and configurations of elements having similar light-directing properties may be used, of course.

The angle β may of course vary depending on the particular shape and configuration of the element 3. For example, by having an element having different angles than those shown between adjacent peaks and troughs the angle β will be different.

Figure 4:
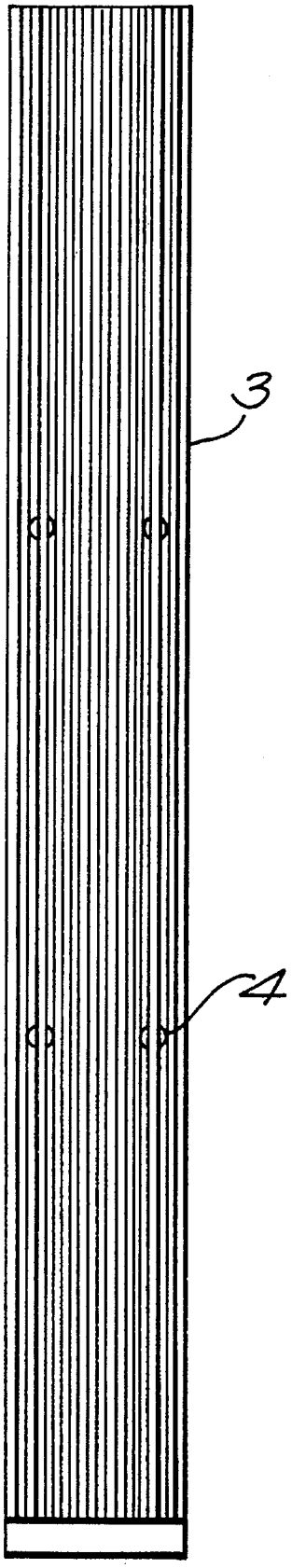
FIG. 4 shows a plan view of the reflective element in situ.
Figure 5:
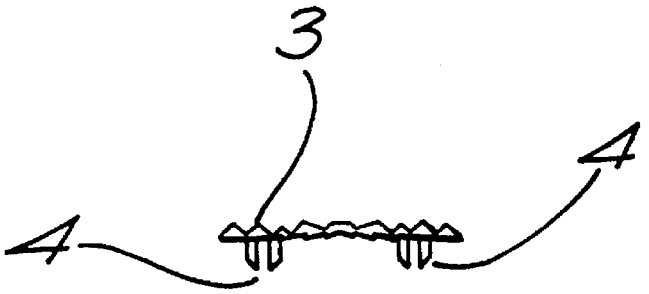
FIG. 5 shows an end view of the reflective element in situ.

FIG. 4 shows a plan view of an element of FIG. 3 in situ. The element is elongate in the direction generally parallel to the elongate direction of the fluorescent lamp element 1. The lens element 3 is mounted, as shown in FIG. 2, between the lamp 1 and rear reflector 2 by means of clips 4 which attach the element 3 to the reflector 2. This is more clearly shown in FIG. 4 which is an end view of the lens element 3 showing the clip 4 in situ. Typically, two pairs of clips are used.

Figure 6A:
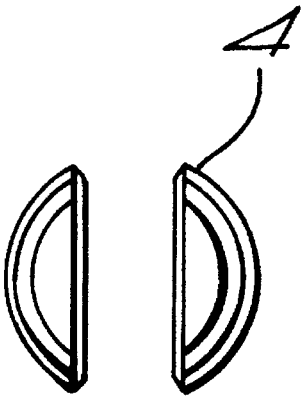
FIG. 6 shows means for attaching the reflector assembly.
Figure 6B:
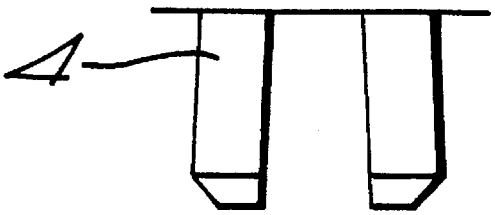

FIG. 6 shows a) a bottom view of a pair of clips 4, and at b) a side view. These clip onto the gear tray 2 in one embodiment. Other means of attaching the element 3 to the rear wall or gear tray may be used.

In a further embodiment, element 3 is integral with, and therefore forms part of, the rear wall, provided this is made of a suitable light transmissive material.

We claim:

1. A luminaire comprising:

a light source; and a light redirecting element disposed behind the light source to cause light impinging upon the redirecting element from the light source to be redirected back past the light source at a chosen angle, the redirecting element being a Fresnel type lens having a first plurality of inclined faces at a lens surface nearest the light source and a second plurality of inclined faces at a lens surface furthest from the light source.

2. A luminaire as claimed in claim 1 further comprising a rear wall, the redirecting elements being interposed between the light source and the rear wall.

3. A luminaire as claimed in claim 2 further comprising clip means for attaching the redirecting element to the rear wall.

4. The luminaire of claim 2, in which the rear wall is reflective.

5. A luminaire as claimed in claim 1 further comprising a rear wall integrally formed with the luminaire.

6. A luminaire as claimed in claim 1 wherein the redirecting element is selected from the group consisting of glass and plastic material.

7. A luminaire as claimed in claim 1 wherein the lens has a central axis and the angle is 60° to the central axis.

8. A luminaire as claimed in claim 1 wherein the redirecting element and light source are both elongated and have respective longitudinal axes, the light source being mounted with the longitudinal axis of the light source in the plane of and parallel to the longitudinal axis of the redirecting element.

* * * * *